US005109992A

United States Patent [19]

Miller

[11] Patent Number: 5,109,992

[45] Date of Patent: May 5, 1992

[54] ADJUSTABLE PEG HOOK

[75] Inventor: Byron R. Miller, Springboro, Ohio

[73] Assignee: The Mead Corporation, Dayton, Ohio

[21] Appl. No.: 695,611

[22] Filed: May 3, 1991

[51] Int. Cl.[5] ..... A47F 5/00

[52] U.S. Cl. ..... 211/59.1; 248/220.4; 248/222.2

[58] Field of Search ..... 211/59.1, 57.1, 87, 211/106; 248/220.3, 220.4, 221.1, 222.2, 225.1, 224.3

[56] References Cited

U.S. PATENT DOCUMENTS

| | | | |
|---|---|---|---|
| 3,297,290 | 1/1967 | Patterson | 211/59.1 X |
| 4,094,415 | 6/1978 | Larson | 211/57.1 |
| 4,674,721 | 6/1987 | Thalenfeld | 248/220.4 |
| 4,688,683 | 8/1987 | Thalenfeld et al. | 248/222.2 |
| 4,762,299 | 8/1988 | Langelier | 21/59.1 X |
| 4,832,298 | 5/1989 | Metcalf | 211/59.1 X |
| 4,871,135 | 10/1989 | Thalenfeld | 211/57.1 X |

*Primary Examiner*—Robert W. Gibson, Jr.
*Attorney, Agent, or Firm*—Biebel & French

[57] ABSTRACT

An adjustable peg hook for use in a pegboard-based merchandising display. The peg hook comprises a suspension bracket for affixation to a pegboard and an insert which slides within a pair of channel passages on the suspension bracket. The insert has a support plate characterized by a height which affords a sliding horizontal adjustment motion and a slight vertical locking motion. A merchandise suspension hook is carried by the support plate. The vertical locking motion causes a pair of nodules on the support to come into locking engagement with a wall of one of the channel passages.

11 Claims, 5 Drawing Sheets 28
30
20
58
20
44
44
58

ADJUSTABLE PEG HOOK

BACKGROUND OF THE INVENTION

Modern merchandising of miscellaneous products for the home and office has been characterized by widespread use of pegboards which are provided with peg openings arranged in square matrices of evenly spaced columns and rows. The products of miscellaneous size and shape are commonly packaged in blister packs which are hung upon hooks mounted upon such pegboards. A hook for such a purpose is welded or otherwise secured to a base member which is imbedded into the pegboard. For this purpose the base member is provided with a pair of pegs having a horizontal spacing equal to the horizontal spacing of peg openings within the pegboard. This spacing is generally uniform throughout the industry, so that such a product hook may be mounted on any readily available pegboard.

One of the problems with conventional peg hooks is that they must be arranged along the pegboard at even multiples of the horizontal distance between peg openings. Since product packages are not generally designed with the spacing of peg openings in mind, the peg hooks often must be spaced along the pegboard at distances which separate the products farther than is necessary for ease of merchandising. This causes inefficient use of increasingly expensive merchandising space.

Various proposals have been made to ameliorate the space problem by providing merchandising hooks which are adjustable relative to their supporting pegs. Typical examples of such proposals are shown in Larson U.S. Pat. No. 4,094,415, in Lodge U.S. Pat. No. 4,693,381 and in Learn U.S. Pat. No. 4,723,663. These prior art devices provide elongated suspension brackets which span a considerable number of peg openings so as to provide sliding support for a plurality of merchandise hooks. However, the length of such devices limits their use to pegboard areas of a rather considerable minimum size. This decreases the versatility of such merchandising devices. It is therefore seen that there is a need for an adjustable peg hook of improved design which has the placement versatility of prior art nonadjustable peg hooks.

SUMMARY OF THE INVENTION

This invention provides an improved peg hook comprising an insert which is slidably received by a suspension bracket having an overall width slightly less than twice the horizontal distance between conventional pegboard openings. The suspension bracket comprises a pair of mounting pegs having a spacing equal to the spacing between peg openings, so that all peg openings along a horizontal pegboard row may be utilized. In a typical merchandising display a series of such hooks may be placed along a pegboard at a nominal spacing of 2 in. with an adjustability in the neighborhood of about 1 in. for each hook. Each hook may be removed from the pegboard and remounted at a new location without disturbing the merchandise mounted thereon.

Locking means are provided for locking the hook at any desired position along its path of travel. For this purpose the suspension bracket comprises upper and lower channel portions defining upper and lower plate passages. The hook is carried by a support plate fitted slidably within the plate passages and characterized by a height which permits a limited amount of vertical locking movement. The support plate is provided with one or more forwardly protruding nodules which bind against a passage wall when the support plate has been moved a predetermined vertical distance. In the preferred embodiment, a pair of nodules are provided near the upper edge of the support plate for engagement against an upper closure wall in response to a slight downward movement of the support plate. This enables secure locking of the insert within the suspension bracket. Unlocking is achieved by a slight reversing movement in the upward direction.

It is therefore an object of this invention to provide an improved, adjustably positionable, peg hook.

It is another object of the invention to provide an improved merchandising display.

Other objects and advantages of the invention will be apparent from the drawing, the following description and the appended claims.

DESCRIPTION OF THE PREFERRED EMBODIMENT

Figure 1:
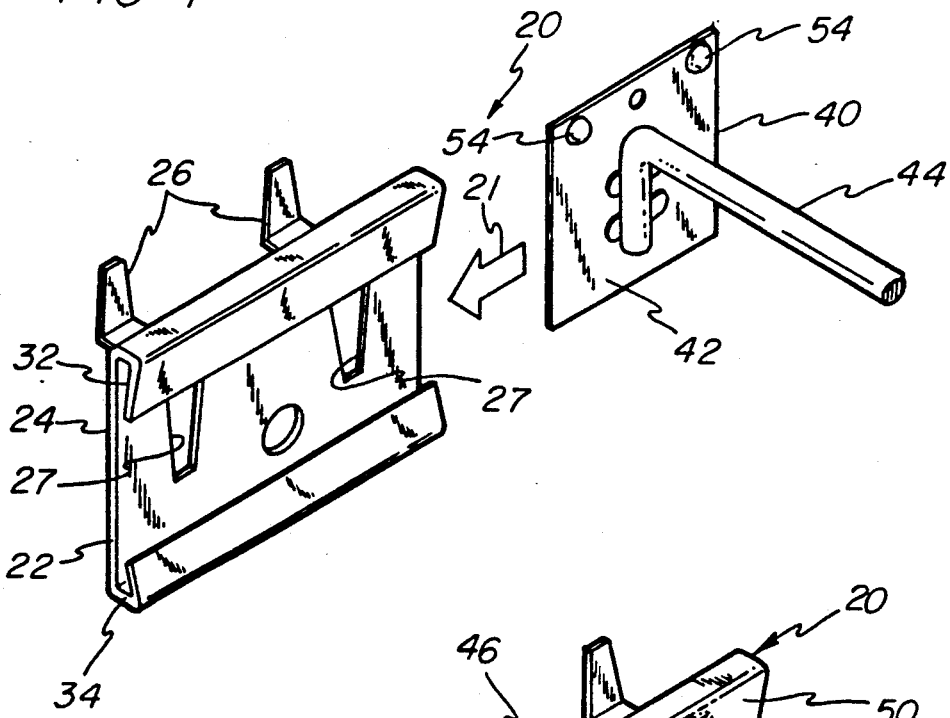
FIG. 1 illustrates the assembly of a suspension bracket and an insert.

In accordance with the present invention, and as illustrated in FIG. 1, a peg hook 20 comprises a suspension bracket 22 into which an insert 40 is inserted. Insertion is accomplished by a sideward motion as indicated by the arrow 21. Insert 40 includes a support plate 42 which is slidably received between an upper channel portion 32 and a lower channel portion 34 of suspension bracket 22. After insertion has been completed, insert 40 may be adjusted by sliding movement to any desirable horizontal position. During such sliding movement, the upper and lower edges of support plate 42 ride within an upper plate passage 36 and a lower plate passage 38 defined within upper channel portion 32 and lower channel portion 34 respectively, as indicated by the arrow 31 of FIG. 2. Thereafter, insert 40 is locked in place by a slight downward movement as indicated by the arrow 41 of FIG. 3 and as described in detail below.

Figure 4:
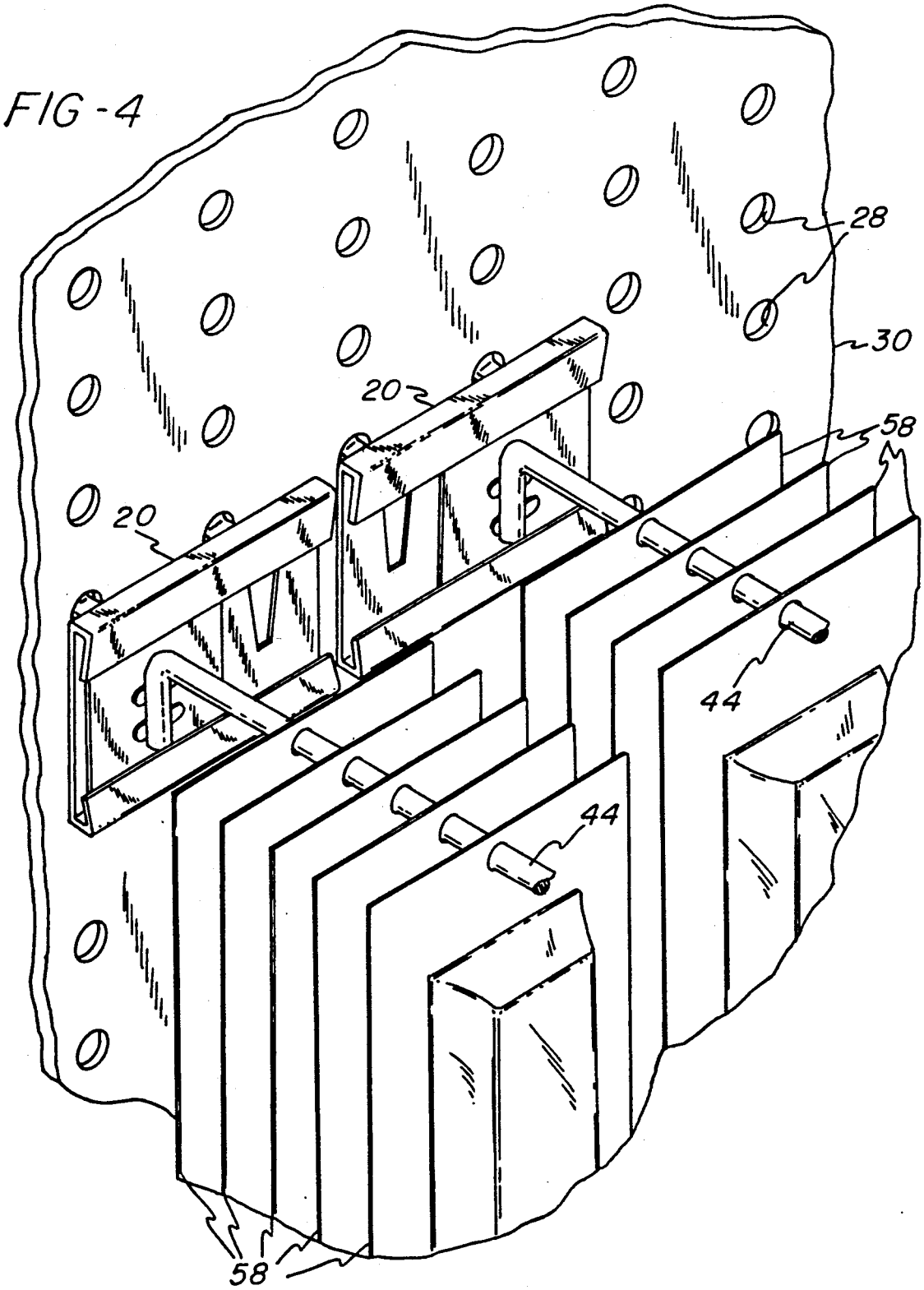
FIG. 4 illustrates a merchandise display on a pegboard.
Figure 6:
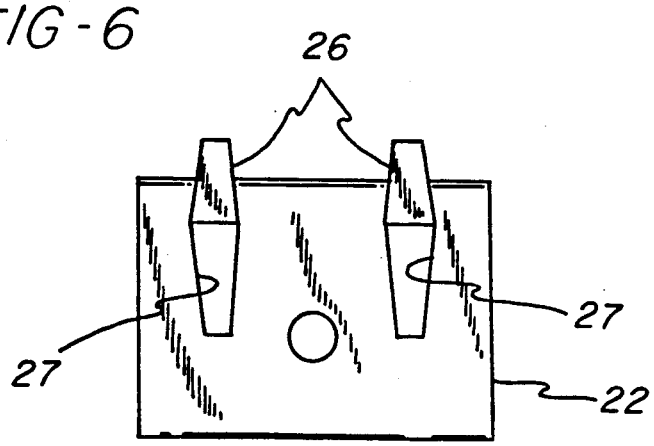
FIG. 6 is a rear elevation view of a suspension bracket.

Suspension bracket 22 comprises a backing plate 24 for supporting the channel members 32,34. A pair of pegs 26,26 are struck out from backing plate 22 thereby defining apertures 27,27, as illustrated in FIGS. 1 and 6. Pegs 26,26 extend rearwardly and thence upwardly for engagement with peg openings 28 in the pegboard 30, as illustrated in FIG. 4. Support plate 42 of insert 40 carries a hook 44 for receiving and suspending merchandise packets 58. Hook 44 may be secured to support plate 42 by conventional spot welding.

Within the United States it is common practice to space pegboard openings within a square matrix of rows and columns at a uniform spacing of 1 in. Therefore, pegs 26 preferably have a 1 in. spacing. Also, suspension bracket 22 has a preferred width of about 1⅞ in., so that two peg hooks 20 may be imbedded side-by-side into four consecutive peg openings 28, as illustrated in FIG. 4.

Figure 5:
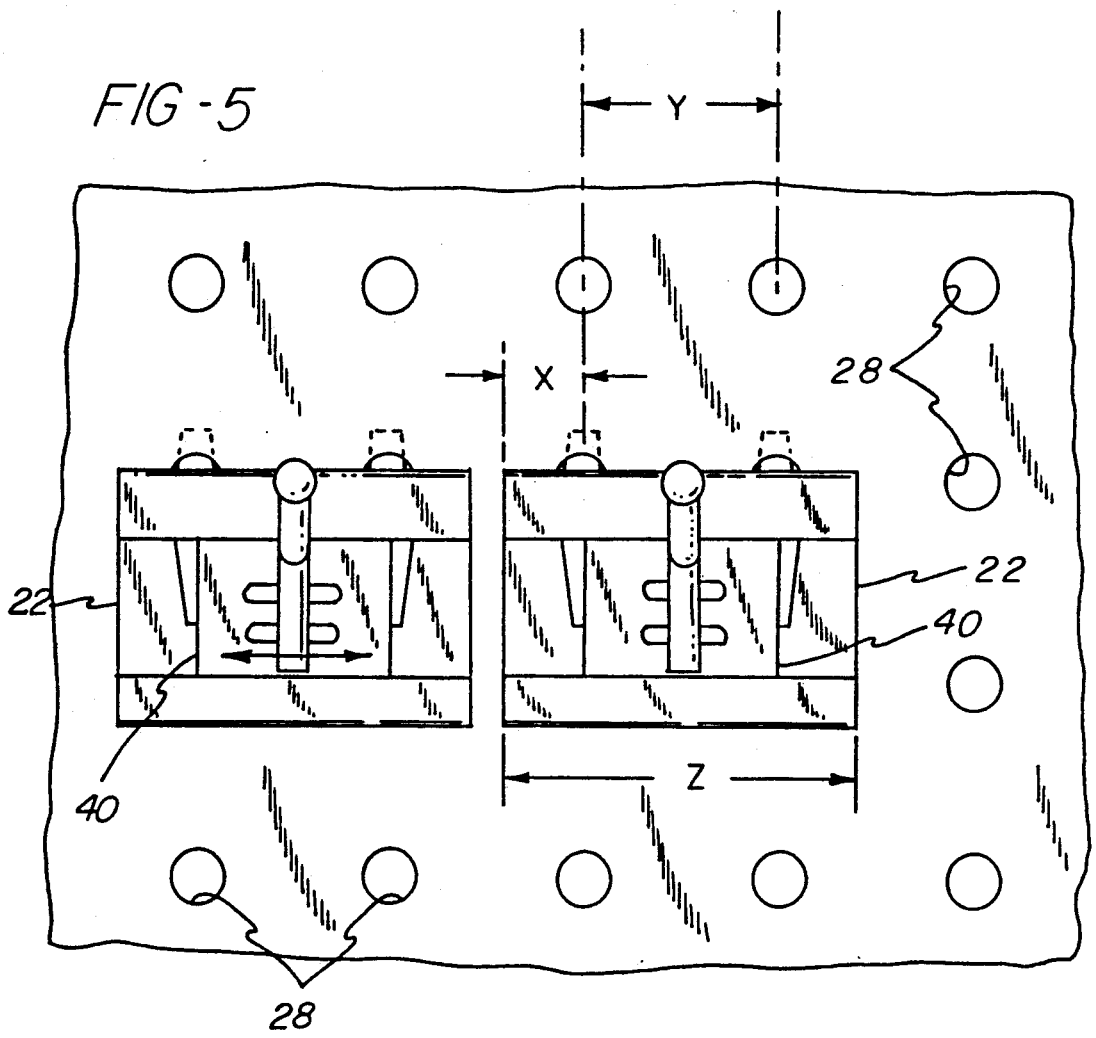
FIG. 5 illustrates the dimensions of a suspension bracket relative to peg openings in a pegboard.

It will be appreciated that the spacing between peg openings 28 need not be exactly 1 in. but may be any other convenient distance Y, as illustrated in FIG. 5. Thus in the general case, suspension bracket 22 has a width Z which is slightly less than 2Y. Pegs 26 preferably are located symmetrically on suspension bracket 22, so that the distance X between a peg opening 28 and the edge of suspension bracket 22 is slightly less than Y/2. In the common situation where Y=1 in., the width Z of suspension bracket 22 is preferably about 1⅞ in., so that two peg hooks 20 may be mounted side-by-side with a clearance of ⅛ in. This enables removal of a fully loaded peg hook 20 for remounting at a new location on pegboard 30. Since inserts 40 are horizontally adjustable, the horizontal position of any hook 44 on a merchandise display may be adjusted to accommodate the specific width of the packages 58 suspended therefrom. Thus the adjustable pegboard hook of the present invention maximizes the utilization of available space on a pegboard-based merchandise display while retaining the versatility of prior art nonadjustable peg hooks.

In order to preserve a desired horizontal spacing between adjacent hooks 44, the present invention provides a simple, yet effective locking feature. Thus, support plate 42 has one or more, preferably two, forwardly facing nodules 54,54. Also, the height of support plate 42 is slightly less than the vertical distance between upper retaining wall 46 and lower retaining wall 48, both of which extend forwardly from backing plate 24. The significance of these relative vertical dimensions may be appreciated by referring now to FIGS. 7 and 8.

Figure 2:
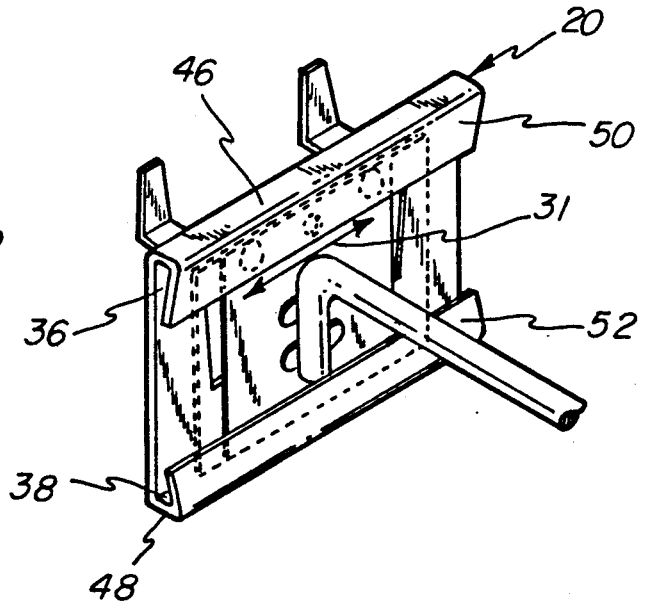
FIG. 2 illustrates sliding adjustment of an insert within a suspension bracket.
Figure 3:
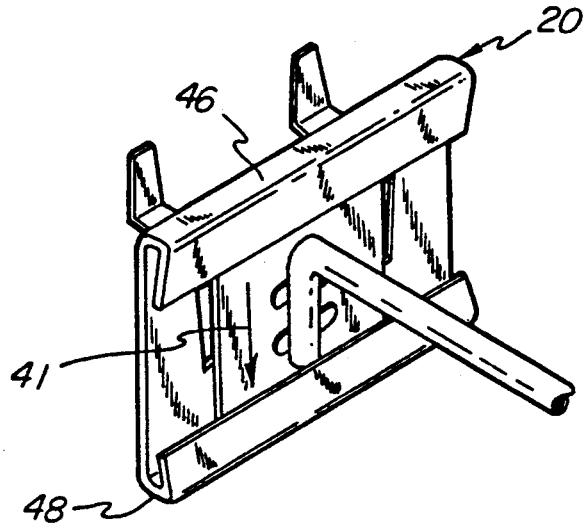
FIG. 3 illustrates the locking movement of an insert within a suspension bracket.
Figure 7:
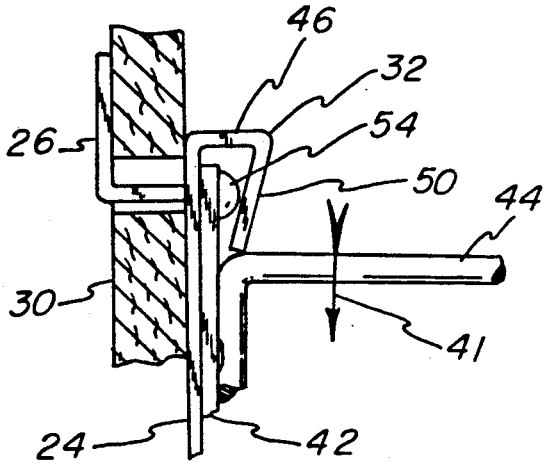
FIGS. 7 and 8 are enlarged side elevation views showing the locking action of an insert within a suspension bracket.

FIG. 7 illustrates the position of nodules 54,54 when insert 40 is in the normal, sliding position of FIG. 2. In that position the nodules 54,54 are positioned close to, but not in interference with, closure wall 50 which extends inwardly and rearwardly from the forward end of retaining wall 46. Locking of insert 40 within suspension bracket 42 is accomplished by a slight downward movement, again as illustrated by the arrow 41.

Figure 8:
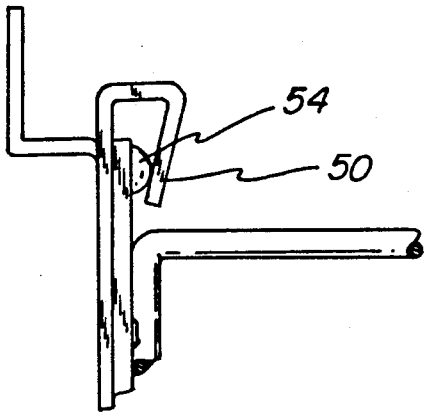

Following downward movement of insert 40, nodules 54,54 come into binding engagement with the rearward surface of closure wall 50. This effectively locks insert 40 against any horizontal sliding movement within suspension bracket 22. A simple reverse motion in the upward direction unlocks insert 40. It will be appreciated that locking could also be accomplished by an alternative embodiment (not illustrated) having one or more nodules 54 positioned at the lower end of support plate 42, rather than at the upper end as illustrated in FIGS. 7 and 8. In such an alternative embodiment, locking would be accomplished by upward motion of insert 40, while unlocking would be accomplished by downward motion thereof. Such an alternative embodiment is not preferred, because the weight of products 58 would tend to unlock insert 40.

Figure 9:
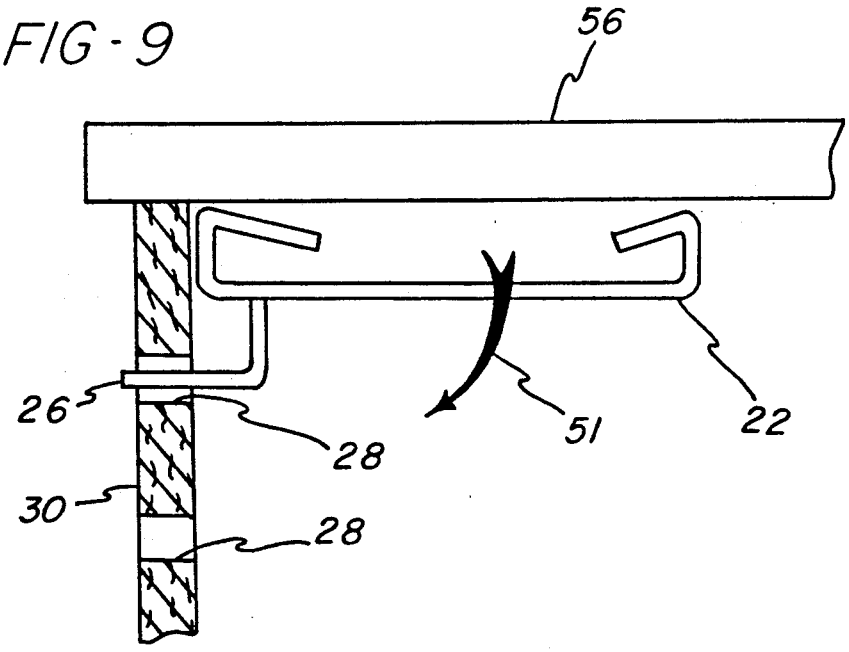
FIG. 9 is a side elevation view illustrating the insertion of a suspension bracket into a top row of pegboard openings.
Figure 10:
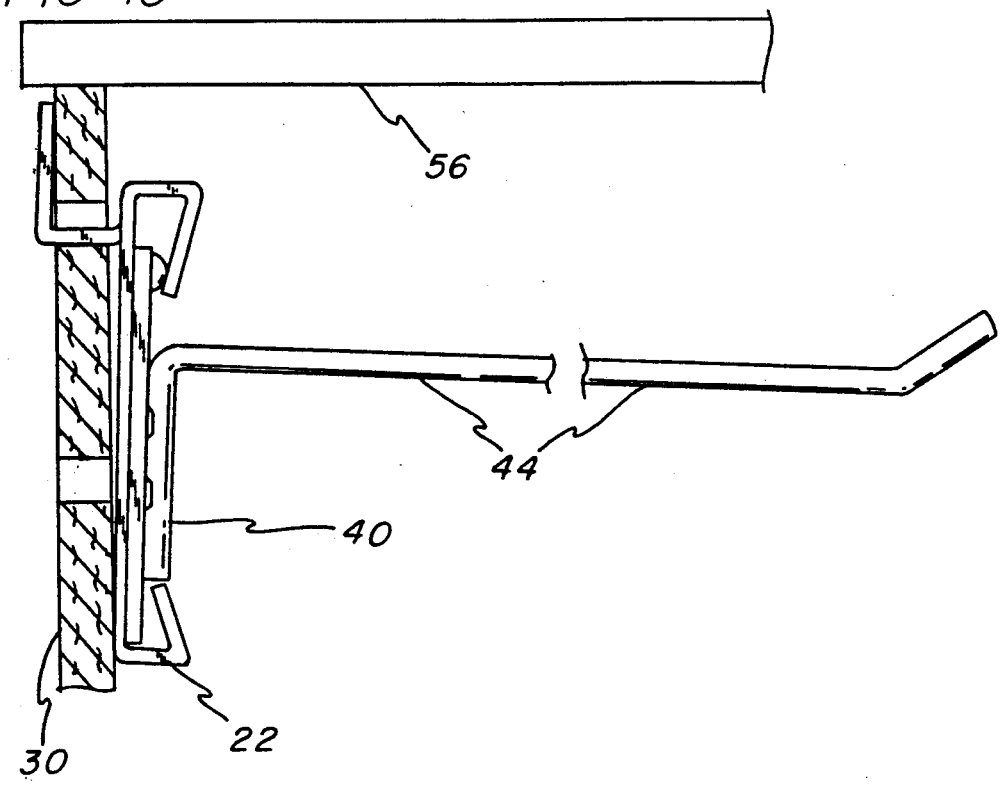
FIG. 10 is a side elevation view illustrating a peg hook mounted in a top row of pegboard openings.

Another advantage of the present invention is illustrated in FIGS. 9 and 10 which illustrate the mounting of a peg hook within peg openings 28 situated near the top of a pegboard 30. In the illustrated example there is a shelf 56 on top of pegboard 30 which creates a clearance problem for hook 44. In accordance with the present invention, suspension bracket 22 is slipped into the peg openings which are closely adjacent shelf 56. (FIG. 9). Thereafter, suspension bracket 22 is snapped into position as indicated by the arrow 51. After this has been accomplished, insert 40 is slid into position and locked, as shown in FIG. 10.

Figure 11:
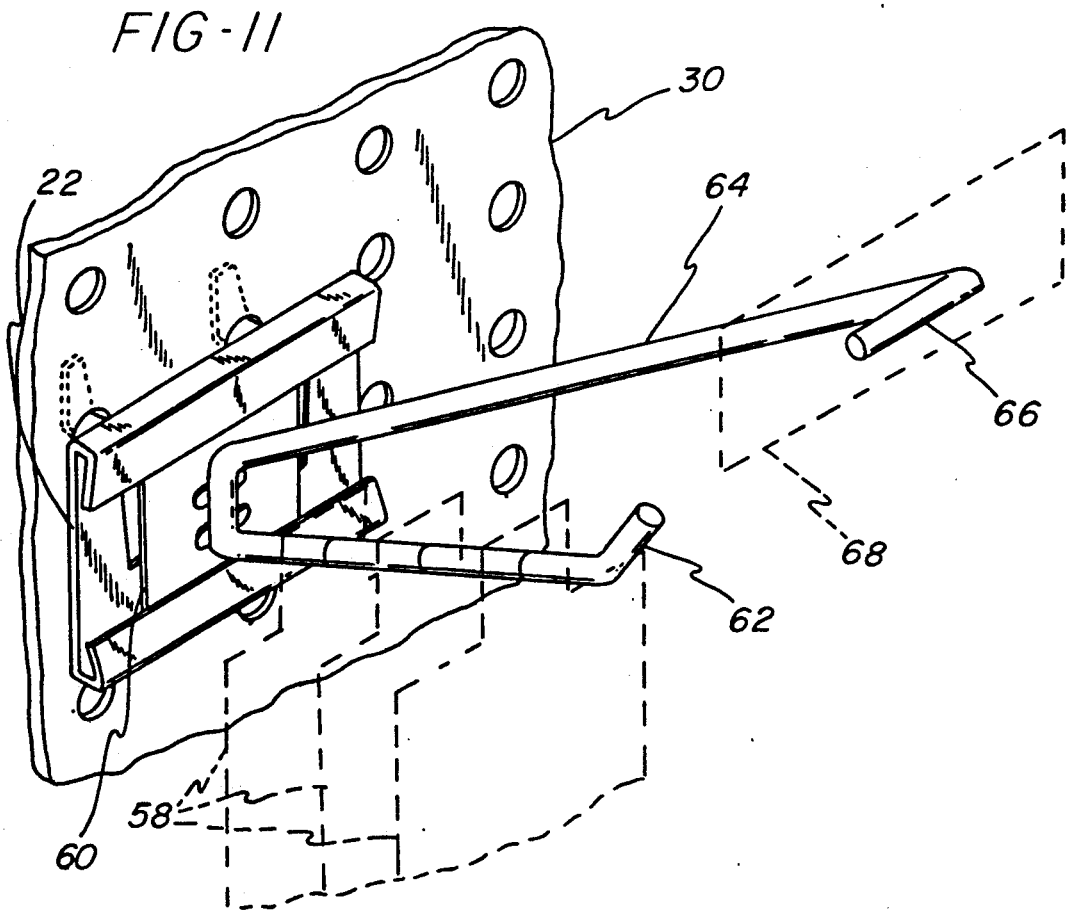
FIG. 11 is a perspective view of a peg hook in an alternative embodiment.

FIG. 11 illustrates an alternative embodiment of the invention having an insert 60 which is provided with a merchandise suspension hook 62 and also a tag support arm 64. Support arm 64 extends upwardly and outwardly from hook 62 and terminates in a horizontally extending crossbar 66. A product identifying tag 68 may be affixed to crossbar 66 by a suitable clip or other fastening means. Product identifying information, including a bar code may be printed on tab 68. The positioning of crossbar 66 facilitates optical scanning of tab 68.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An adjustable peg hook comprising:

a suspension bracket comprising a backing plate, a pair of pegs secured to said backing plate for engagement with spaced peg openings in a pegboard and upper and lower channel portions secured to said backing plate and defining horizontally extending and vertically spaced upper and lower plate passages, an insert comprising a support plate for slidable reception in said upper and lower plate passages and a hook mounted on said support plate, and locking means for selectively locking said support plate at any desired location along the horizontal extent of said passages.

2. An adjustable peg hook according to claim 1 wherein said channel portions each comprise a retaining wall extending forwardly from said backing plate and a closure wall extending inwardly and rearwardly from the forward extent of said retaining wall; said support plate having a height less than the vertical distance between said retaining walls, and said locking means comprising nodule means on the forward face of said support plate for engaging one of said retaining walls in response to vertical movement of said support plate.

3. An adjustable peg hook according to claim 2 wherein said nodule means are positioned near the upper edge of said support plate for engagement with the upper one of said closure walls in response to downward movement of said support plate and disengagement with said closure wall in response to upward movement of said support plate.

4. An adjustable peg hook according to claim 3 wherein said nodule means comprises a pair of horizontally spaced nodules.

5. An adjustable peg hook according to claim 3 wherein the width of said backing is less than twice the horizontal distance between said pegs.

6. An adjustable peg hook according to claim 5 wherein said pegs are positioned symmetrically on said backing plate, so that the distance from each vertical edge of said backing plate to the nearest peg is less than one-half the distance between said pegs.

7. An adjustable peg hook comprising a suspension bracket defined by a backing plate, a pair of pegboard-engaging pegs secured symmetrically in horizontal alignment on the rear surface of said backing plate, an upper channel portion secured to the upper portion of said backing plate, and a lower channel portion secured to the lower portion of said backing plate, and an insert slidably received within said upper and lower channel portions and defined by a support plate configured for sliding reception by said channel portions and a merchandise suspension hook extending forwardly from said support plate; characterized in that said suspension bracket has a width of approximately $1\frac{7}{8}$ in., said pegs have a spacing of 1 in. and locking means are provided for selecting locking said support plate at any desired location along said channel portions.

8. An adjustable peg hook according to claim 7 characterized in that said locking means comprises nodule means on said support plate adjacent the upper edge thereof for locking engagement with a wall of one of said channel portions in response to vertical movement of said support plate.

9. An adjustable peg hook comprising:

a backing plate, a pair of pegboard engaging pegs secured in symmetrical horizontal alignment on the rear surface of said backing plate, an upper channel portion secured to the upper portion of said backing plate, a lower channel portion secured to the lower portion of said backing plate, a support plate for reception between said upper and lower channel portions, a merchandise suspension hook mounted on said support plate and extending forwardly therefrom, and nodule means secured to said support plate near an upper edge thereof;

said support plate having a height enabling horizontally-slidable positioning along said channel portion and a slight vertical locking movement therebetween, and said nodule means being configured for locking engagement against said upper channel portion in response to said vertical locking movement.

10. An adjustable peg hook according to claim 9 wherein said nodule means comprise a pair of horizontally aligned and forwardly facing nodules for engagement against a forward wall of said upper channel portion.

11. A merchandise display comprising:

a pegboard provided with at least one horizontal row of evenly spaced peg openings, a plurality of suspension, brackets imbedded within said row, each suspension bracket having a width slightly less than twice the spacing between said peg openings, a merchandise suspension hook mounted on each suspension bracket, for slidable movement within a predetermined horizontal range, a plurality of merchandise packages suspended on each of said suspension hooks, and downwardly actuated locking means associated with each of said suspension brackets for selectively locking the associated suspension hook at any desired location within said predetermined range.

* * * * *